United States Patent [19]

Foulard et al.

[11] Patent Number: 4,781,122

[45] Date of Patent: Nov. 1, 1988

[54] PROCESS OF CASTING STEEL INCLUDING RENDERING THE STEEL BATH INERT BY MEANS OF LIQUID ARGON OR CARBON DIOXIDE IN THE FORM OF DRY ICE

[75] Inventors: Jean Foulard, Ablon; Raymond Borasci, Chatenay-Malabry, both of France

[73] Assignee: L'Air Liquide, Paris, France

[21] Appl. No.: 125,343

[22] Filed: Nov. 25, 1987

[30] Foreign Application Priority Data

Nov. 26, 1986 [FR] France ..... 86 16475

[51] Int. Cl.[4] ..... B22D 11/10

[52] U.S. Cl. ..... 164/475; 75/96; 164/66.1; 164/259; 164/415; 266/207

[58] Field of Search ..... 164/475, 66.1, 67.1, 164/121, 415, 259; 266/207; 75/96

[56] References Cited

U.S. PATENT DOCUMENTS

| | | | |
|---|---|---|---|
| 4,211,269 | 7/1980 | Bentz et al. | 164/259 X |
| 4,565,234 | 1/1986 | Rimbert | 164/66.1 |
| 4,614,216 | 9/1986 | Savard et al. | 164/67.1 |
| 4,657,587 | 4/1987 | Savard et al. | 75/96 |
| 4,666,511 | 5/1987 | Naud | 75/96 X |

FOREIGN PATENT DOCUMENTS

| | | | |
|---|---|---|---|
| 57-181320 | 11/1982 | Japan | 75/96 |
| 58-154453 | 9/1983 | Japan | 164/475 |
| 70560 | 11/1974 | Luxembourg . | |
| 80/00137 | 2/1980 | PCT Int'l Appl. | 164/66.1 |

OTHER PUBLICATIONS

Abstract of Japanese Patent Publication No. 59-105-5(A) published Jan. 6, 1984.

*Primary Examiner*—Nicholas P. Godici
*Assistant Examiner*—J. Reed Batten, Jr.
*Attorney, Agent, or Firm*—Lee C. Robinson, Jr.

[57] ABSTRACT

Process of casting steel from a ladle into a tundish, in which the metal which is in the tundish is protected against oxidation and nitridation. The process comprises two consecutive steps: a first step which includes flushing the tundish before the start of the casting of the liquid metal during which a high flow of dry ice or liquid argon is introduced until the oxygen concentration in the vicinity of the zone corresponding to the base of the jet of liquid metal at the start of the casting is lower than about 0.5%; and a second step for the upkeep of the atmosphere in the vicinity of the base of the jet which begins when the liquid metal starts to flow in the tundish, during which dry ice or liquid argon is injected as an upkeep flow which is less than the flushing flow, so as to maintain an oxygen concentration lower than about 0.5% in the vicinity of the base of the jet.

15 Claims, 2 Drawing Sheets

PROCESS OF CASTING STEEL INCLUDING RENDERING THE STEEL BATH INERT BY MEANS OF LIQUID ARGON OR CARBON DIOXIDE IN THE FORM OF DRY ICE

BACKGROUND OF INVENTION (a) Field of the Invention

The present invention relates to a process for casting steel from a first container into a second container in which the liquid metal is protected against oxidation and/or nitridation. More particularly, the present invention is directed to a process for the continuous casting of steel which includes the following consecutive steps:

the liquid steel is cast from a converter or an electrical furnace into a ladle, the liquid steel is cast from the ladle into a tundish, the liquid steel is cast from the tundish into at least one continuous casting ingot mold.

(b) Description of Prior Art

On the start of a casting of liquid steel, for example from a ladle into a tundish or during the casting from a first ladle into this tundish, in the case of a process which is carried out sequentially, the liquid metal is in contact with the atmosphere.

The height of the drop of the liquid metal in the tundish and the disturbances taking place result in rather important reactions of nitridation and/or oxidation, which generally last until the complete immersion of the gas-nozzle in the liquid metal which is cast into the tundish, this gas-nozzle being placed at the lower end of the ladle and surrounding the casting jet. After the immersion of the lower portion of the gas-nozzle, the problems resulting from nitridation and/or oxidation are less important because in general, there are used covering powders which are spread on the surface of the liquid metal present in the tundish, or any other known analogous means.

In a general manner, during a ladle-tundish casting, the nitridation and/or oxidation phenomenon mentioned above lasts from about 45 seconds to 4 minutes depending on the size and shape of the tundish. The cast metal which is present in the tundish before the immersion of the gas-nozzle is thus more or less highly oxidized and/or nitrided and the billets or ingots of steel formed from this metal do not possess the desired metallurgical properties.

Among the known processes intended to overcome these disadvantages there is a process known under the commercial name "SPAL", which has been designed by the applicants' assignee and which uses cryogenic liquids such as liquid argon or nitrogen, which very efficiently protect the impact zone of the jet of metal by rendering the bottom of the container inert before the start of the casting and by thereafter covering the surface of the liquid metal to be protected.

However, when it is also intended to produce steels with a low percentage of nitrogen, i.e. when it is intended to prevent a nitridation of steel, it is not possible to use liquid nitrogen to protect the metal melt. In this case, the only process which is actually available at present includes utilizing liquid argon which is spread on the surface of the liquid metal. However, argon is a gas which is relatively expensive and there is presently a search for a more economical solution which would enable metallurgical results which are substantially identical to those obtained when liquid argon is used.

SUMMARY OF INVENTION

The process according to the invention resolves the problem outlined above. For this purpose, it is characterized by the fact that the protection against oxidation and/or nitridation of the liquid metal is carried out by injecting dry ice and/or liquid argon in the tundish, the injection being carried out in two consecutive steps:

a first step which includes flushing the tundish before the start of the casting of the liquid metal, during which there is introduced dry ice and/or liquid argon as a flushing flow in such a manner that the dry ice or the liquid argon at least partially reach the bottom of the tundish where they are at least partially converted into a gas, so as to progressively expel the air which is present in the tundish, this step being terminated when the oxygen concentration in the vicinity of the zone corresponding to the base of the jet of liquid metal at the start of the casting is lower than about 0.5%, a second step for the upkeep of the atmosphere in the vicinity of the base of the jet, which begins when the liquid metal starts to flow in the tundish, during which dry ice and/or liquid argon are introduced as an upkeep flow which is less than the flushing flow, such that the presence of this dry ice, and/or liquid argon or of the gas resulting from the transformation of said dry ice or liquid argon in a zone located in the vicinity of the base of the jet and/or at the surface of the liquid metal in said tundish, maintains an atmosphere containing less than 0.5% by volume of oxygen in said zone, the casting of the liquid steel starting substantially at the end of the first step, preferably immediately at the end thereof.

According to a preferred embodiment, in which the ladle is provided with a gas-nozzle placed around its casting orifice, the second step is terminated as soon as the lower end of the gas-nozzle is substantially immersed in the liquid metal, the surface of the bath of liquid metal in the tundish being then covered with a protecting means, known per se, against oxidation and/or nitridation.

Preferably, the upkeep flow is at most equal to about 50% of the flushing flow.

According to a particularly advantageous embodiment of the invention, the process is characterized by the fact that, before the casting of the liquid steel from the converter or the electrical furnace into the ladle, there is injected in the latter a quantity of dry ice or liquid argon which is sufficient to flush the ladle: this quantity of dry ice is preferably comprised between 0.2 and 5 kg per ton of cast metal, while the flow of liquid argon is higher than 60 liters/min and preferably higher or equal to 80 liters/min. The duration of the flushing operation is determined by measuring the acceptable residual concentration of oxygen at the bottom of the ladle. A normal duration is of the order of 45 seconds.

Of course, in a general manner, the process according to the invention is applicable to the casting of a jet of liquid steel from a first container into a second container, the jet of casting and/or the surface of the bath of liquid metal of the second container being protected against oxidation and/or nitridation by means of carbon dioxide, in the form of dry ice, or liquid argon, which are particularly injected as described above, in two consecutive steps. In the present specification, when the term dry ice is used, it is intended to simultaneously designate dry ice and liquid argon.

BRIEF DESCRIPTION OF DRAWINGS

The invention will be better understood by way of the following examples, given without any intention to limit the scope of this invention, in connection with the drawings in which:

FIG. 4*a* is a schematic cross-section view of another embodiment of the invention, while

DESCRIPTION OF PREFERRED EMBODIMENTS

Figure 1:
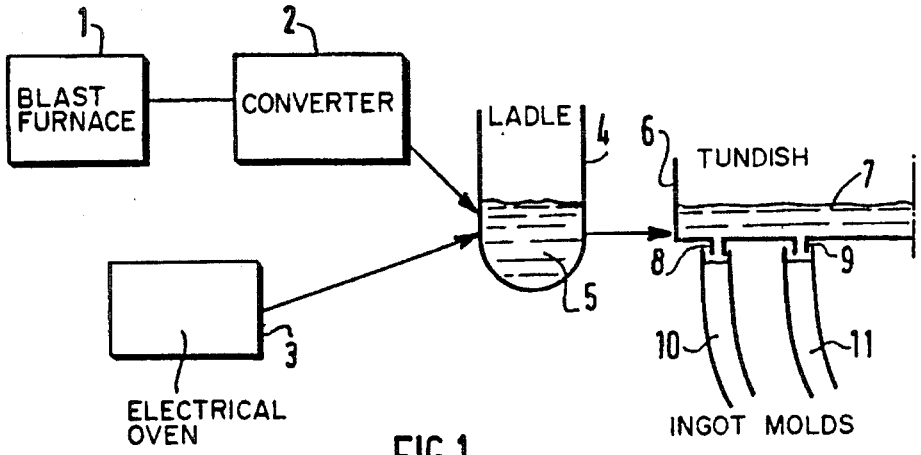
FIG. 1 is a schematical representation of the various steps of casting a steel from a blast furnace or an electrical furnace.

FIG. 1 is a schematic view of the various steps during the production of a steel ingot. Schematically, this steel is prepared either from a blast furnace 1 feeding cast iron which is refined in an oxygen converter 2, or from an electrical arc furnace 3 using scrap iron as starting material, the steel 5 obtained being, in both cases, poured into a ladle 4, this ladle serving to feed a tundish 6 provided with a plurality of orifices 8, 9, placed above continuous casting ingot molds 10, 11. The tundish contains molten steel 7 which is regularly fed by means of ladles 4 during a sequential operation or by means of a single ladle 4 when a continuous casting is carried out ladle by ladle.

During the continuous casting process, the liquid metal can be submitted to oxidation and/or nitridation.

When steel exits from a converter, it is effervescent during the start of the casting in the ladle Then the effervescence slows down during the casting, i.e. all the oxygen accumulated when blowing oxygen in the cast iron is removed in order to refine the latter and to convert same into steel. As soon as oxygen has been removed from steel, one is then faced with the problem of oxidation and of nitridation. A problem of this type has already been resolved by using the process described by the applicants' assignee in European Pat. No. 196952.

When steel is supplied by an electrical furnace, the jet of liquid metal can be oxidized and/or nitrided already at the start of the casting from the electrical furnace into the ladel. It is therefore desirable, in a general manner, to make sure that the liquid metal in the vicinity of the ladle be inert. Of course, if the grade produced and previously treated in the ladle, requires another metallurgical treatment in the ladle, with or without heating, such as, the deep injection of Si-Ca, for example, or the use of a stuffed thread, and/or a homogenization by bubbling, it can be found useful to proceed to render the surface of the molten metal inert by covering the latter with a layer of dry ice and/or liquid argon in order to prevent the re-oxidation and/or re-nitridation of the metal. Of course, these treatments at the level of the ladle are separate from those carried out at the level of the tundish. They can be carried out independently of the latter or in combination with the treatment at the level of the tundish.

When the ladle is filled with steel, the latter is transferred into tundish 6 by means of gas-nozzle 12 generally located under the ladle. At the start of the casting from the ladle into the tundish, the liquid metal is in contact with the atmosphere and the drop height and the disturbances produce nitridation and/or oxidation reactions which could be important. It is an object of the present invention, for example, to provide a process which renders the tundish inert. This is however only generally necessary until the immersion of the gas-nozzle in the liquid metal contained in the tundish, because it is known that as soon as this immersion is substantially completed, liquid metal is covered with so called covering powders which limit the oxidation and/or nitridation. However, it can be useful, in the case of specific grades of steel, to improve the inerting by means of powders by adding additional carbon dioxide in the form of dry ice. In certain cases, it is preferred to use only dry ice, in specific quantity.

The tundish 6 is provided with orifices 8 and 9 enabling the casting of the liquid metal in ingot molds 10 and 11. The jet of liquid metal is also, in this location, subjected to the action of the surrounding atmosphere, thereby generating an oxidation and/or nitridation. This problem has been resolved by a process as described in European Application No. 213 042.

Actually, we are therefore essentially faced with the problem of inerting the tundish and this will be explained more fully by reference to FIG. 2 where there is represented a partial cross-section view of a tundish 6 above which has been placed a ladle 4 provided with a gas-nozzle 12. Means 13, 14, 15 are provided to inject dry ice or liquid argon: the container 13 for liquid carbon dioxide (or liquid argon) is connected to lance 15 by means of a valve 14 (and a nozzle not illustrated) through which liquid carbon dioxide is blown into dry ice which is projected in the zone 20 of the tundish. (The argon remains liquid during its passage through valve 14). The tundish essentially comprises a lateral wall 25 and a bottom wall 16 in which there are casting orifices 8. These various walls 25, 16 as well as the orifice 8 are provided with a refractory coating. A low partition 17 is mounted opposite wall 25 with respect to the casting orifice 8 while a baffle 18 is placed in the upper part of the tundish, but slightly offset with respect to the low partition, and more remote from the orifice 8 than said low partition 17. In the embodiment illustrated in FIG. 2, the gas-nozzle 12 of the ladle 4 is disposed between two baffles 18 (only one being represented in the figure) so that the gas-nozzle is in a zone defined by the low partitions 17 on one hand, and the baffles 18 on the other hand. In the example illustrated in FIG. 2, the lower end of the gas-nozzle 12 is at a distance $d_2$ from the bottom 16 of the tundish 6, which distance is higher than height $d_1$ of the low partition 17, but shorter than the distance $d_3$ which separates the lower part of the baffle 18 from the bottom 16 of the tundish 6. The end 21 of the lance 15 is preferably spaced from the bottom 16 of the tundish. This distance is in the neighbourhood of the distance $d_3$, thereby enabling a better penetration of dry ice at the bottom of the tundish when injecting the latter. Of course, if the low partition 17 is sufficiently high, the distance $d_2$ can be lower than $d_1$.

The operation of the process according to the invention is as follows:

Before initiating the casting from the ladle into the tundish or at the start of a casting sequence ladle—tundish, the first step of the process consists in flushing the tundish from the air present in the latter. For this purpose, by means of lance 15, whose end is disposed as described above, there is introduced an important quantity of dry ice, which, under the casting conditions (cold or hot tundish before the start of the casting) is sufficient to cause the dry ice to be deposited at least partially at the bottom of the tundish, in zone 20, located in the vicinity of the lower portion of the gas-nozzle 12 and extending to the low partition 17. By adjusting the flow of dry ice in a suitable manner, and by eventually providing a plurality of lances placed at different locations in the space between the gas-nozzle and the baffle 18, this flushing operation of the tundish is carried out for a length of time which is of the order of 30 seconds to about 1 minute. An oxygen probe is placed in the zone 20, in the vicinity of the lower portion of the gas-nozzle 12, and it is generally considered that the flushing has been correctly carried out when the concentration of oxygen is lower than 0.5%. In any case, for a given tundish, it suffices to effect the necessary controls and measurements once, to be advised of the duration of this flushing as a function of a given flow of dry ice. It is then not necessary to place the probe at the bottom of the tundish; however it is sufficient to measure the duration of a corresponding injection, for a given flow of dry ice. The end of the flushing operation produces the casting of the ladle in the tundish. Indeed, it is very important that the liquid metal flows into the tundish at the end of this flushing flow, because otherwise, a relatively rapid increase of the oxygen concentration is observed within a delay of the order of about 1 minute. In certain cases, it would therefore be possible to maintain this flushing flow at a high rate for a few moments after having started the casting operation in the tundish, or to start again the flushing operation in case of incidents, at the outlet of the ladle, if any.

At the start of the casting of the liquid metal through the gas-nozzle 12, the dry ice which is present in zone 20 is rapidly sublimated, but a thickness of dry ice is maintained by injection of dry ice through the lance 15, by means of a second flow, or maintenance flow, which is less than the flushing flow. This maintenance flow should however be sufficient for the dry ice to cover the liquid metal during the progressive filling of the tundish, including when this liquid metal reaches a level which is higher than height $d_1$ of the low partition, and is then rapidly spread in the entire tundish. This upkeep flow, in the form of a flow which is constant or substantially regularly decreases, is maintained, until the lower end 22 of the gas-nozzle 12 is substantially immersed in the bath of liquid steel. The term substantially is understood to mean an immersion such that taking in account the usual bubblings or disturbances in this type of casting, the lower end 22 always remains inside the liquid metal. When this is accomplished, the injection of carbon dioxide in the form of dry ice at the surface of the liquid metal is generally stopped and the surface of the metal is covered by means of a protecting powder or any other means known to those skilled in the art to limit the oxidation and/or nitridation of the steel melt. Of course, the operation of covering the surface of the liquid metal with powder can be initiated before stopping the injection of dry ice. In this latter case, it will be possible, for example for specific grades of steel, to continue the injection of dry ice according to the upkeep flow (constant or decreasing), or according to an inferior flow or by sequential injection of dry ice, so as always to maintain at least a thin layer of dry ice which then cooperates with the covering powder or any other equivalent means.

By using dry ice, there is thus produced at the surface of the metal to be made inert, a large quantity of cold gas (845 liters of gas per kilo of dry ice). This gas has a high density, of the order of 1.9, which, when it is in the lower part of the tundish, flushes the air which was there previously and isolates the liquid metal from the surrounding atmosphere, by coming between the ambient air and the bath of liquid metal during the entire casting of the liquid metal.

Figure 3:
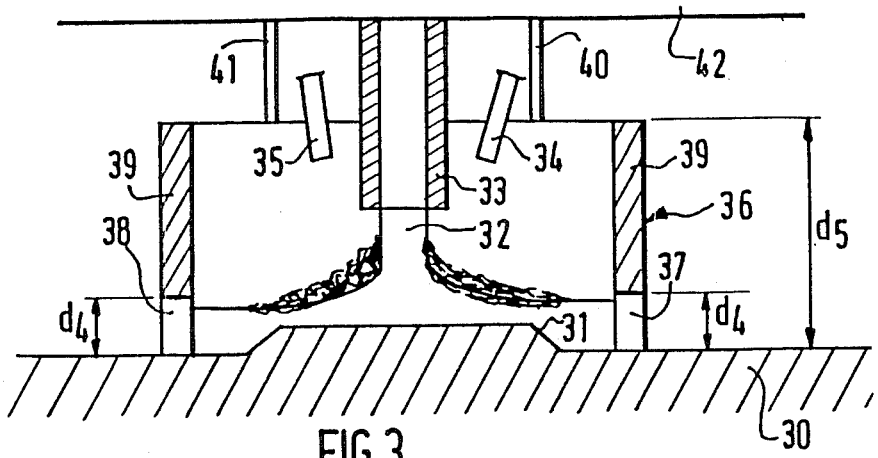
FIG. 3 is a modification of the invention, in a tundish without a low wall.

In FIG. 3 there is represented a variant of the process according to the invention in a tundish without a low partition.

In this case, there is provided a device 36 having a height $d_5$ to confine the carbon dioxide in the form of dry ice, injected in the vicinity of the base of the jet, as well as the gas resulting from the sublimation of this dry ice.

This confining device 36 comprises a substantially cylindrical jacket 39 provided with a plurality of openings 37, 38, the height of which is $d_4$. The openings are designed to cause the liquid metal to flow in the tundish 30 having an elevated portion 31 according to a flow corresponding to that of the metal 32 through the gas-nozzle 33, thereby preventing an overflow of the metal above the walls 39 of the device 36. This cylindrical device 36, which can be made of a (consumable) metal, (non-consumable) refractory material or of thick cardboard (which is slowly consumed) is fixed by the flanges 40, 41, for example on the walls of the ladle 42. The dry ice is injected, preferably symmetrically on either side of the gas-nozzle 33, by means of the lances 34, 35. The level of liquid metal progressively increases in the tundish until the gas-nozzle is immersed in the liquid metal, and the continuous casting is then generally carried out at a flow which is equal to the flow of liquid metal through the gas-nozzle. In this device, the greater the diameter of the device 36, the more the height of the openings is reduced (with equal surface) and therefore the better is the confinement of the jet of metal. However, this diameter is limited by the width of the tundish, as well as by the consumption of dry ice during the casting operation. These openings are preferably located in the longitudinal portion of the tundish to promote a flow parallel to the walls of the tundish.

Figure 4A:
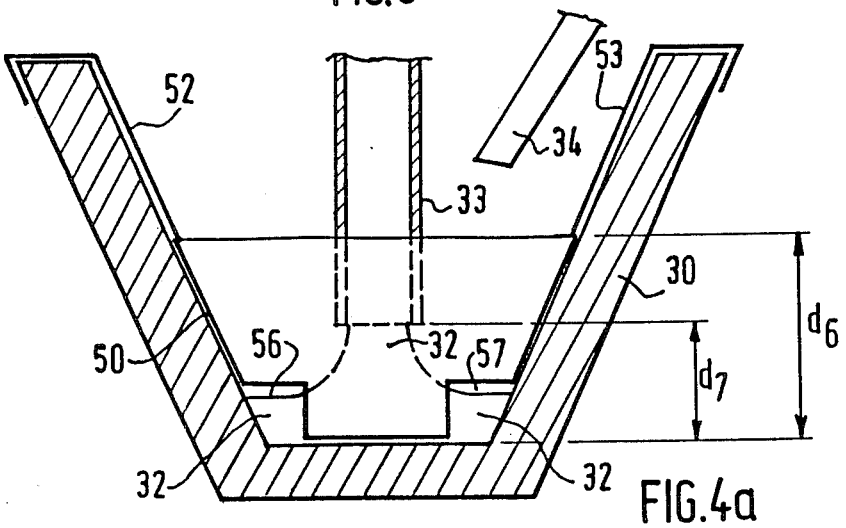
Figure 4B:
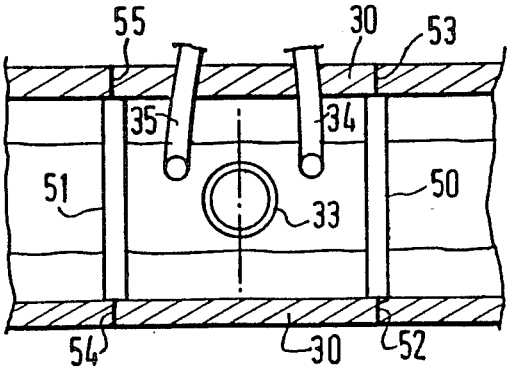
FIG. 4*b* is a view from above.

FIG. 4*a*, is a schematic cross-section view of another embodiment of the invention, while FIG. 4*b* is a view from above. The same elements as those of FIG. 3 are represented by the same reference numerals.

In the present case, the tundish 30 is (of narrow width) but of long length. In this case, the protecting device is limited to two lateral partitions 50, 51, which follow substantially the shape of the tundish. The height d6 of these lateral partitions is larger, as previously, than the distance d7 between the lower base of the gas-nozzle and the bottom of the tundish. Each partition comprises openings 56, 57 in its lower portion, which openings are disposed in such a manner that they enable liquid metal to flow longitudinally with respect to the tundish. Those openings are placed in the lower corners of the partitions.

Each partition 50, 51 is fixed by means of two connectign pieces 52, 53, and 54, 55, whose lower ends are unitary with the corresponding partition and whose upper ends wrap around corresponding lateral walls of the tundish 30. The lances are oriented in such a manner that the jets of dry ice, depending on the flows corresponding to the invention, preferably come in contact with the metal between the gas-nozzle and the partitions 50, 51, in the vicinity of the base of the jet and substantially in the vertical zone of the partition 50, 51 not provided with openings (56, 57), in order to improve the confinement, particularly at the start of the casting. The distance between the partitions 50, 51 follows substantially the same rules as those defined for the determination of the diameter of the device 36 of FIG. 3, for example with respect to the surface of the openings 56, 57, their number and/or their arrangement. Of course, the distance between the partitions 50, 51 should remain reasonable in order that the device serves its function of confinement. This distance can, for example be of the same order as the width of the partitions 50, 51.

EXAMPLE 1

Figure 2:
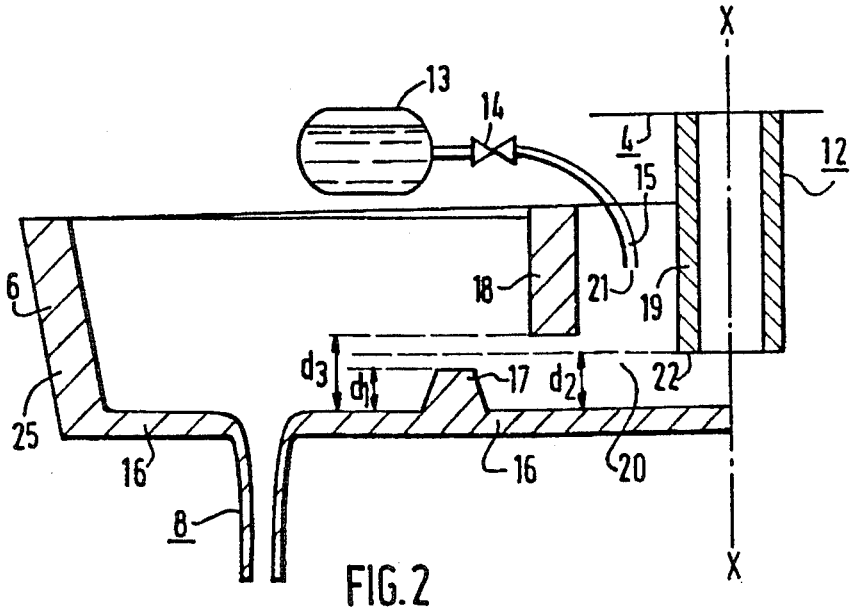
FIG. 2 is a partial cross-section view of an embodiment where the invention is carried out in a tundish.

Starting from a casting ladle of 140 tons of mild steel killed with aluminum, the latter is cast in a 13 ton tundish with low partitions and baffles, without cover, as represented in FIG. 2. The step of flushing the central zone around the gas-nozzle lasts between 30 seconds and 1 minute and 30 seconds, with a flow of $C_2$ in the form of dry ice of 15 to 50Kg/minute.

At the start of the casting, the flushing operation ends and a so-called "upkeep" flow is injected, which comprises between 10 and 30 Kg/minute of $CO_2$ in the form of dry ice. In the two cases, the dry ice is injected preferably at two locations, on either side of the gas-nozze, until complete immersion of the nozzle, generally during about 40 seconds and 3 minutes and 30 seconds.

EXAMPLE 2

The process of example 1 is repeated except that liquid argon is used instead of dry ice. The durations of injection are the same as for the flushing and upkeep flows respectively. However, the duration of the flushing step can be slightly decreased with respect to that of Example 1, since liquid argon more rapidly produces the desired inerting. This duration can be between 20 and 90 seconds.

The flow of liquid argon during the flushing stage is between 15 and 30 l/min and preferably 20 l/min, for a preferred duration of 45 seconds, while the flow is 4 l to 10 l per minute and preferably 6 l/min during the upkeep step whose duration is at least equal to that of the casting.

It has been observed that the use of liquid argon sligtly decreases the oxidation of the metal as compared to the utilization of dry ice, with which the results are however excellent.

Of course, as indicated above, it is also possible, according to the invention, to provide for a homogenizing stirring in the tundish, by injecting gaseous argon, nitrogen or carbon dioxide in the liquid metal, by means of a lance or a porous plug.

We claim:

1. Process of casting steel, by casting a jet of liquid steel from a first container into a second container, protecting the casting jet and/or the surface of the bath of liquid steel in the second container against oxidation and/or nitridation, wherein the protection of liquid steel against oxidation and/or nitridation is carried out by injecting dry ice or liquid argon in the second container in two consecutive steps:

a first step for flushing the second container, which takes place before the start of the casting of the liquid steel, during which dry ice or liquid argon is injected to provide a flushing flow such that said dry ice or said liquid argon at least partially reaches the bottom of the second container and is converted at least partially into a gas to progressively expel air present in said second container, said step being over when the concentration of oxygen in the vicinity of the base of the jet of liquid steel at the start of the casting is lower than 0.5%, a second step for maintaining the atmosphere in the vicinity of the base of the jet which begins substantially when the liquid steel starts to be cast in the second container, during which dry ice or liquid argon is injected according to an upkeep flow, which is lower than the flushing flow, such that the presence of said dry ice, liquid argon or gas resulting from their transformation in the vicinity of the base of the jet maintains an atmosphere containing less than about 0.5% oxygen in said zone.

2. Process according to claim 1 wherein dry ice is injected during the flushing step for between about 30 seconds and 90 seconds, and the flow of dry ice is between 15 Kg to 50 Kg per minute.

3. Process according to claim 1 wherein dry ice is injected during the second step for between about 40 seconds and 210 seconds, with a flow of dryice of 10 to 30 Kg/minute.

4. Process according to claim 1 wherein liquid argon is injected during the flushing step for between 20 seconds and 90 seconds with a flow of liquid argon between 15 liters and 30 liters per minute.

5. Process according to claim 1 wherein liquid argon is injected during the second step for between about 40 seconds and 210 seconds with a flow of liquid argon between 4 liters and 10 liters per minute.

6. Process for the continuous casting of steel which comrises:

pouring liquid steel from a container into a ladle, then pouring a jet of the liquid steel from the ladle into a tundish, then pouring the liquid steel from the tundish into at least one continuous casting ingot mold, wherein the jet which is poured from the ladle into the tundish is protected by injecting dry ice or liquid argon in the tundish in two consecutive steps:

a first step of flushing the tundish, which takes place before the start of the pouring of the liquid steel into the tundish, during which dry ice or liquid argon is injected as a flushing flow such that said dry ice or said liquid argon at least partially reaches the bottom of the tundish and is converted at least partially into gas so as to progressively expel air present in said tundish, said step being terminated when the concentration of oxygen in the vicinity of the base of the jet of liquid steel at the start of the casting is lower than about 0.5%, a second step for maintaining the atmosphere in the vicinity of the base of the jet which begins substantially when the liquid steel starts to flow into the tundish, during which dry ice or liquid argon is injected according as an upkeep flow, which is lower than the flushing flow, such that the presence of the dry ice, liquid argon or gas resulting from their transformation in the vicinity of the base of the jet maintains an atmosphere containing less than about 0.5% oxygen in said zone.

7. Process according to claim 6, in which the ladle is provided with a casting orifice and a gas-nozzle placed around the casting orifice, wherein the second step ends as soon as the lower end of the gas-nozzle is substantially immersed in the liquid steel in the tundish.

8. Process according to claim 7, wherein the surface of the bath of liquid steel in the tundish is covered with a means for protection against oxidation and/or nitridation, a few moments before the end of the second step.

9. Process according to claim 8, wherein a flow of dry ice or liquid argon is maintained after the end of the second step.

10. Process according to claim 2 wherein said upkeep flow is not more than about 50% of the flushing flow.

11. Process according to claim 6 wherein before the pouring of liquid steel into the ladle, dry ice or liquid argon is injected in the ladle to flush said ladle.

12. Process according to claim 11 wherein the quantity of dry ice injected into the ladle is between 0.2 and 5 kg per ton of liquid steel.

13. Process according to claim 7, wherein liquid argon is injected to flush the ladle at a rate of at least 60 liters/min.

14. Process according to claim 7 which comprises stirring the liquid steel in the tundish.

15. Process according to claim 14, wherein the surface of the liquid steel in the ladle is rendered inert by means of dry ice or liquid argon.

* * * * *